US008109412B2

(12) United States Patent
Decottignies et al.

(10) Patent No.: US 8,109,412 B2
(45) Date of Patent: Feb. 7, 2012

(54) DISPENSING NOZZLE FOR A DISPENSER OF FLUID PRODUCT

(75) Inventors: Laurent Decottignies, Cergy (FR); Myriam Bourdon, Croissy sur Seine (FR)

(73) Assignee: Airlessystems, Charleval (FR)

( * ) Notice: Subject to any disclaimer, the term of this patent is extended or adjusted under 35 U.S.C. 154(b) by 558 days.

(21) Appl. No.: 12/160,131

(22) PCT Filed: Nov. 24, 2006

(86) PCT No.: PCT/FR2006/051226

§ 371 (c)(1),
(2), (4) Date: Oct. 22, 2008

(87) PCT Pub. No.: WO2007/093679

PCT Pub. Date: Aug. 23, 2007

(65) Prior Publication Data

US 2009/0179048 A1 Jul. 16, 2009

(30) Foreign Application Priority Data

Feb. 14, 2006 (FR) ..... 06 50517

(51) Int. Cl.
*B67D 5/06* (2006.01)

(52) U.S. Cl. ..... 222/108; 222/205; 222/402.13; 222/490

(58) Field of Classification Search ..... 222/108–111, 222/205, 490, 402.13
See application file for complete search history.

(56) References Cited

U.S. PATENT DOCUMENTS

| | | | | | |
|---|---|---|---|---|---|
| 100,393 | A | * | 3/1870 | Gray | 222/385 |
| 101,069 | A | * | 3/1870 | Wilder | 222/111 |
| 168,393 | A | * | 10/1875 | Gray | 222/109 |
| 1,061,099 | A | * | 5/1913 | Miller | 222/51 |
| 2,000,493 | A | * | 5/1935 | Miller | 222/205 |
| 2,722,224 | A | | 11/1955 | Blann | |
| 2,915,223 | A | * | 12/1959 | Beall, Jr. | 222/109 |
| 3,078,014 | A | * | 2/1963 | Livingstone | 222/110 |
| 3,744,678 | A | | 7/1973 | Beres et al. | |
| 3,792,802 | A | | 2/1974 | Gores | |
| 3,874,561 | A | * | 4/1975 | Zackheim et al. | 222/207 |
| 3,917,127 | A | | 11/1975 | Berenstain | |
| 4,139,124 | A | * | 2/1979 | Ferrante | 222/110 |
| 4,349,129 | A | * | 9/1982 | Amneus | 222/41 |
| 4,635,823 | A | * | 1/1987 | Stull | 222/108 |
| 4,757,922 | A | * | 7/1988 | Landecker | 222/205 |
| 4,815,616 | A | * | 3/1989 | Silvenis | 215/232 |
| 5,379,919 | A | * | 1/1995 | Gueret | 222/108 |

(Continued)

FOREIGN PATENT DOCUMENTS

DE 42 01 342 C1 3/1993

*Primary Examiner* — Kevin P Shaver
*Assistant Examiner* — Donnell Long
(74) *Attorney, Agent, or Firm* — Sughrue Mion, PLLC

(57) ABSTRACT

A dispenser head (1) for associating with a dispenser member, such as a pump or a valve, so as to form a fluid dispenser, the head including a connection sleeve (11) for connecting to an outlet (31) of the dispenser member, the sleeve (11) being connected to a fluid dispenser orifice (13, 13') via an internal channel (12), the head being characterized in that it further includes a fluid collection dish (14) for collecting the fluid at the outlet from the dispenser orifice, the dish defining a bottom (141) that is situated below the dispenser orifice under normal conditions of use of the head, such that the fluid drops by gravity into the dish.

17 Claims, 3 Drawing Sheets

U.S. PATENT DOCUMENTS 5,964,379 A * 10/1999 DeMars ..... 222/205
6,264,067 B1 * 7/2001 Lasserre ..... 222/108
7,255,250 B2 * 8/2007 Pugne ..... 222/556
2007/0295754 A1 * 12/2007 Tourigny ..... 222/205
2009/0045223 A1 * 2/2009 Laidler et al. ..... 222/108

* cited by examiner

DISPENSING NOZZLE FOR A DISPENSER OF FLUID PRODUCT

The present invention relates to a dispenser head for associating with a dispenser member, such as a pump or a valve, so as to form a fluid dispenser. The fluid can be dispensed in any way, e.g. in the form of spray, a jet, a string, or a glob. In general, the head includes a connection sleeve for connecting to a pump or valve outlet. The sleeve is internally connected to a fluid dispenser orifice via an internal channel. The fluid can thus flow from the outlet of the pump or of the valve through the internal channel as far as the dispenser orifice where the user can recover the fluid. This type of dispenser head is very frequently used in the fields of cosmetics, perfumery, or even pharmacy.

Dispenser heads of this type can be adapted to dispense various kinds of fluid ranging from more viscous fluids, such as gels, creams, and pastes, to less viscous fluids, such as lotions and fragrances. Taking, for example, viscous fluids such as creams, pastes, and gels: dispensing is generally performed in the form of thick lumps of fluid that are similar to strings or globs. The user is thus constrained to recover the dispensed fluid directly at the outlet of the dispenser orifice. Recovery is generally performed by means of one or more fingers, or by a specific applicator. In order to make it easier to recover the viscous fluid, the dispenser head can, for example, be formed with a spout at the end of which the dispenser orifice is situated. It is thus easy for the user to place the fingers or the hand under the spout, and to dispense the fluid directly onto the finger or the hand. Alternatively the dispenser head naturally need not be provided with such a spout, such that it is necessary to press the fingers, the hand, or the specific applicator against the dispenser head just below the dispenser orifice. Conventionally, the user is constrained to recover the fluid as soon as it leaves the dispenser orifice. As a result, it can happen that the fluid is not recovered correctly: the fluid may be dispensed poorly onto the fingers, the hand, or the specific applicator, for example. It can also happen that recovery fails, and the fluid drops onto the floor. In any event, it is necessary to have good co-ordination between dispensing and recovery, given that they are completely distinct.

An object of the present invention is to remedy the above-mentioned drawbacks of the prior art by defining a dispenser head for which recovery of the fluid is easier for the user.

To do this, the present invention proposes a dispenser head for associating with a dispenser member, such as a pump or a valve, so as to form a fluid dispenser, the head including a connection sleeve for connecting to an outlet of the dispenser member, the sleeve being connected to a fluid dispenser orifice via an internal channel, the head being characterized in that it further includes a fluid collection dish for collecting the fluid at the outlet from the dispenser orifice, the dish defining a bottom that is situated below the dispenser orifice under normal conditions of use of the head, such that the fluid drops by gravity into the dish. Thus, the dispenser orifice is not obstructed or clogged with the fluid that has been dispensed. With this head, the user proceeds initially to dispense fluid into the collection dish, and then recovers the fluid from the dish. As a result, the dispensing of the fluid and the recovery of the fluid by the user are actions that are completely independent from each other, since they are separated by an intermediate stage in a collection dish.

In another advantageous aspect of the invention, the dish may define a bottom, and a side that is substantially vertical under normal conditions of use of the head, the dispenser orifice being formed in the vertical side, such that the fluid can flow by gravity into the bottom of the dish. The dish advantageously defines an access rim that is substantially horizontal, and that is situated opposite the vertical side. The access rim makes it very easy for the user to recover the fluid accumulated in the collection dish. Advantageously, the bottom of the dish is deeper in the proximity of the vertical side and slopes gently up to the access rim. In an advantageous embodiment, the access rim extends over a fraction of the outer periphery of the head. Thus, the user can easily recover the fluid by wiping the bottom of the dish.

In another advantageous aspect of the invention, the dispenser head may further include a pusher that overlies the dish. Advantageously, the dish partially surrounds the pusher. In this way, the dish can be made with a wide variety of shapes, while conserving a large capacity for the dish. The bottom of the dish is advantageously connected to the pusher via the vertical side.

In another advantageous aspect of the invention, the sleeve defines an axis X, and the pusher defines an axis Y that is parallel to the axis X, but that is offset therefrom. This means that the thrust axis of the pusher is offset relative to the axis of the pump or of the valve. This is a characteristic that can be implemented independently of the fact that the dispenser head includes a collection dish. This is therefore a characteristic that can be protected on its own. However, in combination with a collection dish, this makes it possible to offset the pusher to one side of the head and to use the space made available in this way for the collection dish that can therefore present maximum capacity for a given dispenser head.

According to another characteristic of the invention, the dispenser orifice is formed by a self-sealing slot that defines two lips that are in leaktight contact in the absence of fluid under pressure inside the head. The slot is advantageously formed in a core of deformable flexible material, the head being made by dual-injection, the core being injected-molded into a housing formed by the head.

The invention is described more fully below with reference to the accompanying drawings which show two embodiments of the invention by way of non-limiting example.

Figure 1:
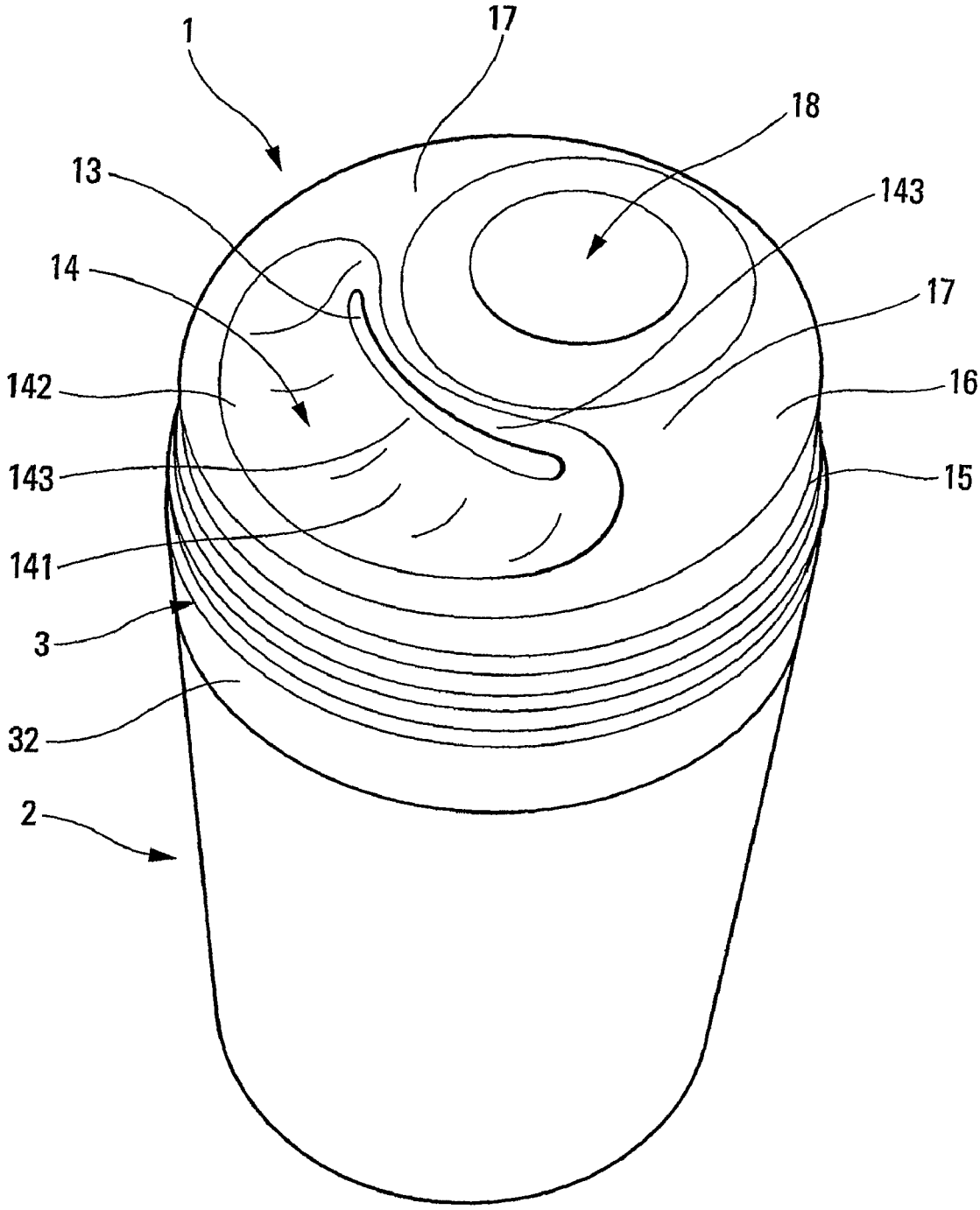
FIG. 1 is a perspective view of a fluid dispenser constituting a first embodiment of the invention.

Reference is made firstly to FIG. 1 which shows a fluid dispenser integrating a dispenser head constituting a first embodiment of the invention. The dispenser includes a reservoir 2 that can be made from any appropriate material and that can present any shape. In FIG. 1, the reservoir presents a circularly-cylindrical configuration.

A dispenser unit 3 is mounted on the reservoir 2: the unit 3 includes a dispenser member (not shown), such as a pump or a valve. The pump or valve is mounted in a fastener ring 32 that is visible in FIG. 1. In conventional manner, the pump or the valve includes an actuator rod 31 that can be moved axially down and up. The rod 31 is shown in part in FIG. 4. The inlet of the pump or of the valve is in communication with the inside of the reservoir 2 such that the pump or the valve can take fluid stored in the reservoir 2 through its inlet. Then, by actuating the rod 31, the fluid is caused to flow out from the pump or the valve through the rod 31. This characteristic is entirely conventional for dispensers in the fields of cosmetics, perfumery, or even pharmacy.

Figure 2:
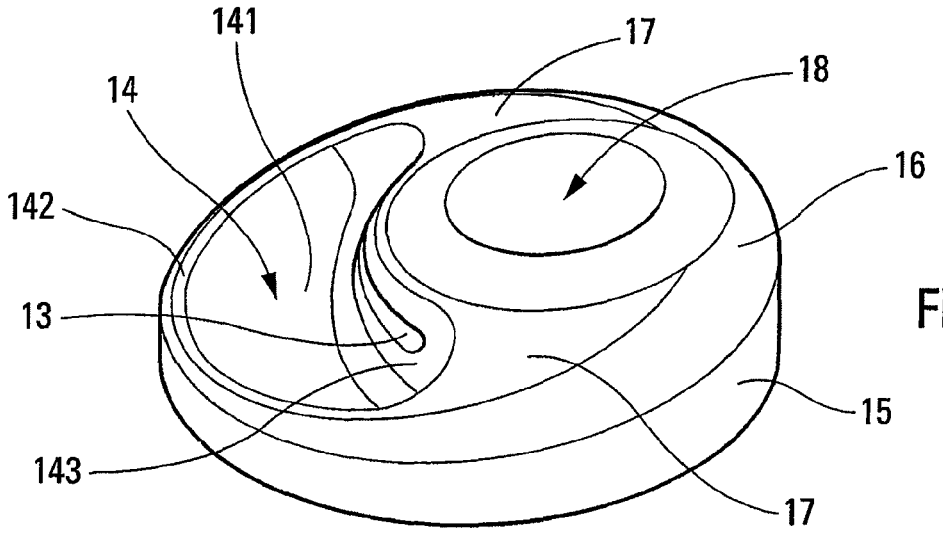
FIG. 2 is a perspective view of the FIG. 1 dispenser head.
Figure 3:
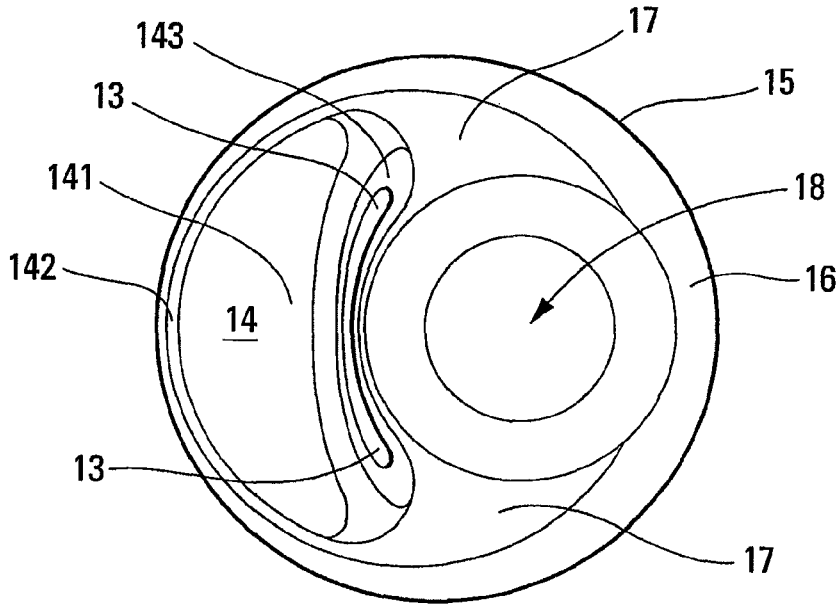
FIG. 3 is a plan view of the FIG. 2 dispenser head.
Figure 4:
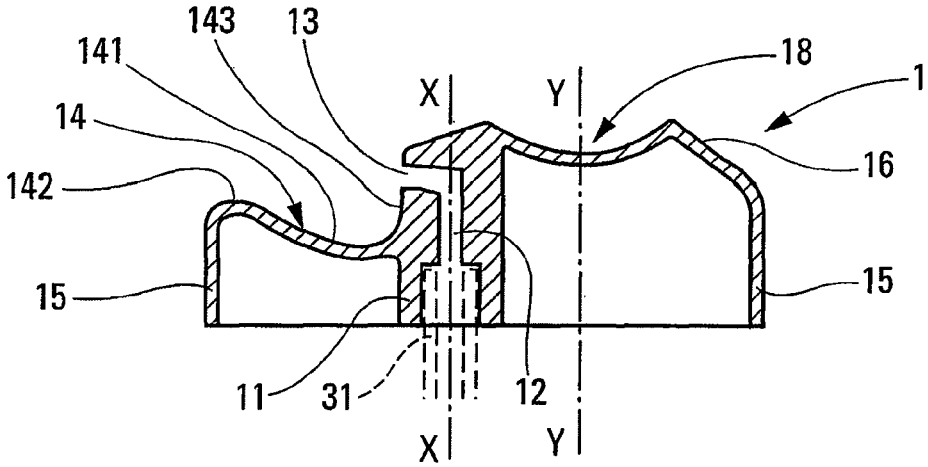
FIG. 4 is a vertical section view through the dispenser head in FIGS. 2 and 3.

The dispenser also includes a dispenser head that incorporates the present invention. Reference is made below to all of the figures while explaining the structure and the functions of the dispenser head. In FIG. 4, which is a vertical section view, it can be seen that the head 1 includes a connection sleeve 11 that, in this embodiment, is interfitted on the free end of an actuator and dispenser rod 31 forming part of a pump or a valve. The sleeve 11 defines an internal housing in which the rod can be received by force. Beyond the sleeve 11, the head defines an outlet channel 12 that is terminated by a dispenser orifice 13. The orifice 13 opens out into a substantially vertical wall 143 that defines a steep side of a collection dish 14. The orifice 13 can be situated at any height in the vertical side 143, but the orifice 13 is preferably situated generally in the proximity of the top of the vertical side 143. The major portion of the vertical side 143 is thus situated below the orifice 13. It can also be said that the sleeve 11 and the actuator rod 31 define a vertical actuation axis X that, in practice, coincides with the axis of the pump or of the valve. In this context, it can be said that the dispenser orifice 13 is situated axially above the foot of the side 143. The vertical or steep side 143 extends in curved manner, defining the right-hand boundary of the dish 14, as shown in FIGS. 1, 2, and 3. At its foot, the side 143 is connected to the bottom 141 of the dish 14 that defines its greatest depth in the proximity of the foot of the side 143. Starting from its deepest point, the bottom 141 slopes gently up to an access rim 142 that is substantially horizontal. The rim 142 defines the left-hand boundary of the dish 14 as shown in FIGS. 2, 3, and 4. The steep side 143 and the access rim 142 meet at their ends, forming transition zones.

As a result of the position of the orifice 13 at the top of the steep side 143, the dispensed fluid flows or drops to the bottom 141 of the dish 14 that is situated axially lower down than the side 143. The fluid can be squirted directly to the bottom 141 of the dish or it can flow down the side 143 to the bottom 141. The fluid accumulated in this way in the dish 14 can be easily recovered by the user from the access rim 142. Recovery can be performed by means of one or more fingers, or even by means of a specific applicator. It should be observed that the access rim 142 extends over a considerable portion of the outer periphery of the head, thereby making it even easier to access the dish 14. The user can thus recover the fluid by wiping or passing from one end of the access rim 142 to the other. In the embodiment shown in the figures, the access rim 142 extends over substantially one third of the periphery of the head. With regard to the steep side 143, it extends substantially transversally with a curve in the same direction as the rim 142, thereby imparting a kidney shape to the dish. It should also be observed in the figures that the dispenser orifice 13 is in the form of an elongate window that follows the curve of the steep side 143. In this way, the fluid is dispensed substantially uniformly to the bottom 141 of the dish. Instead of said single elongate orifice, it is also possible to provide a single orifice that is more point-like, or, on the contrary, it is possible to provide a plurality of distinct orifices. Provision can even be made for the head 1 to be mounted on a dispenser of the dual type, including two pumps or two valves. In this event, the collection dish is for collecting two different fluids, e.g. dispensed through two different dispenser orifices or through a single dispenser orifice.

The dispenser head constituting this embodiment also includes a pusher 18 on which the user can press by means of one or more fingers so as to move the dispenser head, and thus the actuator rod 31 of the pump or of the valve. In response, a dose of fluid is dispensed through the orifice 13 into the bottom 141 of the dish 14. In this particular embodiment, the pusher 18 overlies the dish 14 and is connected to the dish via the steep wall 143 defining the orifice 13. In other words, the pusher 18 is situated axially higher than the bottom 141 of the dish 14. However, it can also be envisaged to position the pusher 18 at the same level as the dish or even lower, for purposes of appearance or functionality. As can be seen in FIGS. 1, 2, and 3, the steep side 143 extends around part of the pusher 18 that, in this embodiment, presents an annular or circular shape. The pusher 18 can define a central indentation in which the user can insert a finger so as to exert pressure. The pusher 18 thus defines a thrust axis Y that is preferably parallel to the actuation axis X. However, as can be seen in FIG. 4, the axis Y is distinct from the axis X, since they are disposed in parallel but offset manner. Offsetting the thrust axis of the pusher from the actuation axis of the pump or of the valve is a characteristic that can be implemented independently of the fact that the dispenser head integrates a collection dish.

With reference to FIG. 3, it can be seen that the dish 14 presents the shape of a kidney bean forming a concave portion in which the pusher 18 is integrated. As a result, the dish surrounds the pusher at least in part, in particular via its steep wall 143. On either side of the pusher 18, the dish 14 is connected to the pusher 18 via two side areas 17 of complex shape. Further away, the head defines a peripheral ring 16 of varying width. The ring 16 is its widest beside the pusher 18 and its narrowest beside the access rim 142. The asymmetrical ring 16 is then extended downwards by a cylindrical skirt 15 that is adapted to move inside or around the fastener ring 32 of the fastener unit 3.

Figure 5:
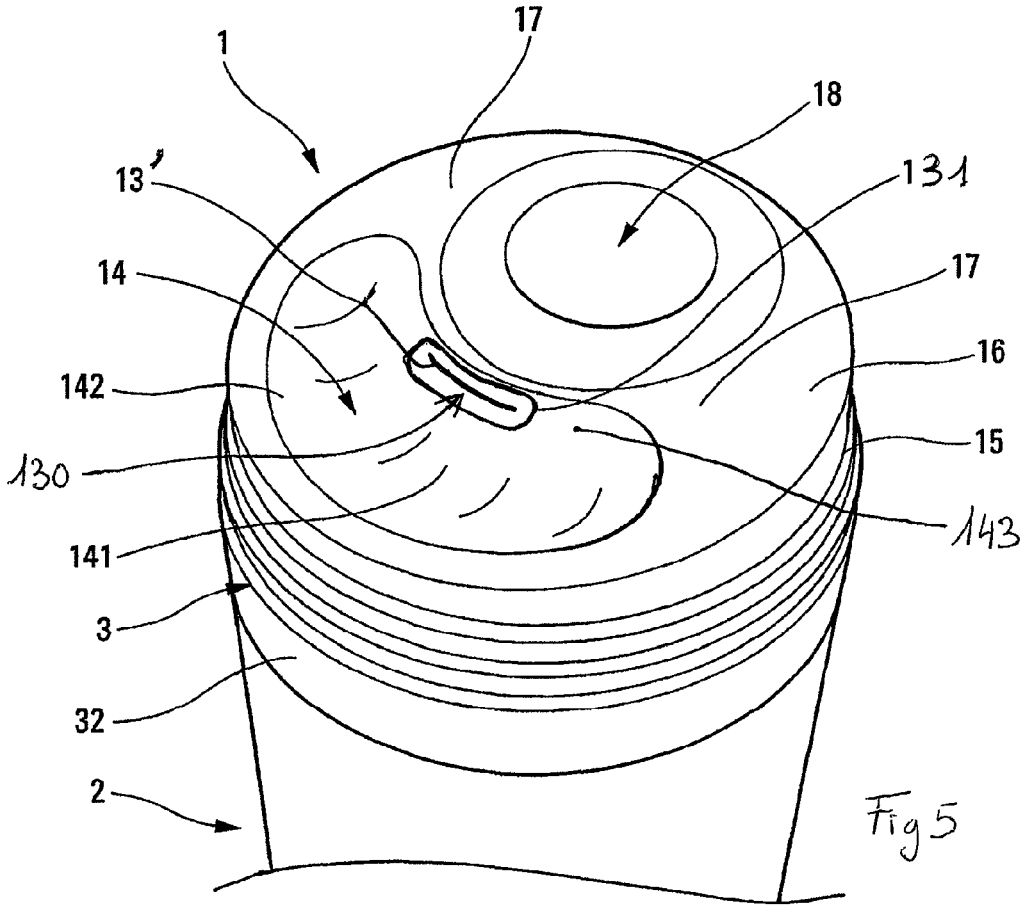
FIG. 5 is a view similar to FIG. 1 constituting a second embodiment of the invention.
Figure 6:
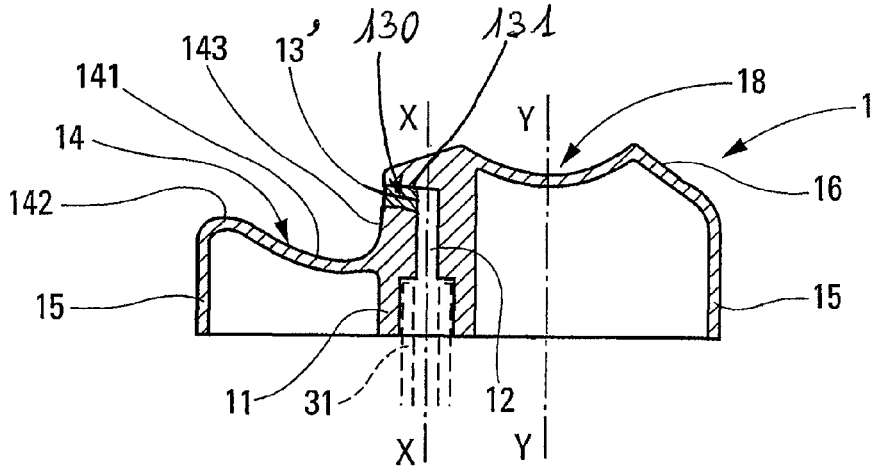
FIG. 6 is a view similar to FIG. 4 constituting the second embodiment.

Reference is made below to FIGS. 5 and 6 that show a dispenser head constituting a second embodiment of the invention.

The head presents a general configuration that is substantially similar to the configuration in FIGS. 1 to 4. The head includes a dish 14 that defines a bottom 141, a steep wall 143, and an access rim 142. However, in this embodiment the fluid dispenser orifice is formed by a self-sealing slot 13' that is formed in a core 130 made of a deformable flexible material. The slot 13' comprises two opposite lips that are in leaktight contact when at rest, i.e. when there is no fluid under pressure inside the outlet channel 12. However, when the fluid in the channel 12 exceeds a certain threshold pressure, the lips move apart so as to define an outlet passage for the fluid. The core 130 occupies a housing 131 that connects the channel 12 to the steep wall 143 of the dish. The housing 131 extends along all or part of the steep wall. The core 130 is advantageously made by dual-injection, being molded together with the remainder of the head that is made of a plastics material that is harder. In this technique, the core and its housing are molded in a single mold. In a variant, the core could be overmolded inside the head. Dual-injection or overmolding can be used for this embodiment because the housing 131 connects with the channel 12 that can be made by means of a mold pin. In addition, the core engaged between the channel 12 and the steep wall 143 is of small thickness. Once unmolded, it suffices to slit the core 130 by means of a blade so as to form the self-sealing slot 13'.

Given that the self-sealing slot is leaktight at rest, it fulfils an automatic-closure function. It can also fulfill an outlet-valve function for a pump that does not have an outlet valve.

Naturally, the figures show only one particular set of shapes for the pusher and the dish 14. Without going beyond the ambit of the present invention, it is naturally possible to imagine a dish 14 with a shape that is completely different, and a pusher with a shape or a configuration that is completely different.

The invention claimed is:

1. A dispenser head for associating with a dispenser member so as to form a fluid dispenser, the head including a connection sleeve for connecting to an outlet of the dispenser member, the sleeve being connected to a fluid dispenser orifice at the end of an internal channel, the fluid being collectable directly at the outlet of the dispenser orifice;

the head further includes a fluid collection dish from which a user may collect the fluid at the outlet from the dispenser orifice, the dish defining a bottom that is situated below the dispenser orifice under normal conditions of use of the head, such that the fluid, dropping by gravity into the dish, may be collected by a user;

the dish defines a bottom and a side that is substantially steep under normal conditions of use of the head, the dispenser orifice being formed in the steep side, such that the fluid can flow by gravity into the bottom of the dish;

the dish defines an access rim that is substantially horizontal, and that is situated opposite the steep side;

the bottom of the dish is deeper in the proximity of the steep side and slopes gently up to the access rim.

2. A dispenser head for associating with a dispenser member so as to form a fluid dispenser, the head comprising:

a connection sleeve for connecting to an outlet of the dispenser member, the sleeve connected to a fluid dispenser orifice at the end of an internal channel, the fluid being collectable directly at the outlet of the dispenser orifice;

a fluid collection dish from which a user may collect the fluid at the outlet from the dispenser orifice, the dish defining a bottom situated below the dispenser orifice under normal conditions of use of the head, such that the fluid, dropping by gravity into the dish, may be collected by a user; and a pusher that overlies the dish.

3. The dispenser head according to claim 2, in which the dish defines a bottom, and a side that is substantially steep under normal conditions of use of the head, the dispenser orifice being formed in the steep side, such that the fluid can flow by gravity into the bottom of the dish.

4. The dispenser head according to claim 3, in which the dish defines an access rim that is substantially horizontal, and that is situated opposite the steep side.

5. The dispenser head according to claim 4, in which the bottom of the dish is deeper in the proximity of the steep side and slopes gently up to the access rim.

6. The dispenser head according to claim 4, in which the access rim extends over a portion of the outer periphery of the head.

7. The dispenser head according to claim 2, in which the dishpartially surrounds the pusher.

8. A dispenser head for associating with a dispenser member so as to form a fluid dispenser, the head comprising:

a connection sleeve for connecting to an outlet of the dispenser member, the sleeve connected to a fluid dispenser orifice at the end of an internal channel, the fluid being collectable directly at the outlet of the dispenser orifice;

a fluid collection dish from which a user may collect the fluid at the outlet from the dispenser orifice, the dish defining a bottom situated below the dispenser orifice under normal conditions of use of the head, such that the fluid, dropping by gravity into the dish, may be collected by a user;

the dish defines a bottom, and a side that is substantially steep under normal conditions of use of the head, the dispenser orifice being formed in the steep side, such that the fluid can flow by gravity into the bottom of the dish;

the bottom of the dish is connected to a pusher via the steep side.

9. The dispenser head according to claim 2, in which the sleeve defines an axis X, and the pusher defines an axis Y that is parallel to the axis X, but that is offset therefrom.

10. A dispenser head for associating with a dispenser member so as to form a fluid dispenser, the head comprising:

a connection sleeve for connecting to an outlet of the dispenser member, the sleeve connected to a fluid dispenser orifice at the end of an internal channel, the fluid being collectable directly at the outlet of the dispenser orifice;

a fluid collection dish from which a user may collect the fluid at the outlet from the dispenser orifice, the dish defining a bottom situated below the dispenser orifice under normal conditions of use of the head, such that the fluid, dropping by gravity into the dish, may be collected by a user;

the dispenser orifice is formed by a self-sealing slot that defines two lips that are in leaktight contact in the absence of fluid under pressure inside the head.

11. The dispenser head according to claim 10, in which the slot is formed in a core of deformable flexible material, the head being made by dual-injection, the core being injected-molded into a housing formed by the head.

12. The dispenser head according to claim 2, wherein the dispenser member is a pump or a valve.

13. A dispenser head for associating with a dispenser member, so as to form a fluid dispenser, the head comprising:

a fluid dispensing orifice;

a connection sleeve configured to connect to an outlet of the dispenser member, the connection sleeve connected to a fluid dispenser orifice at the end of an internal channel of the dispensing head;

a fluid collection dish with a wide opening configured to collect fluid directly from the fluid dispensing orifice and allow a user direct access to the fluid collected in the collection dish, the collection dish defining a bottom below the dispenser orifice under normal conditions of use of the head, such that the fluid drops by gravity directly into the dish, the wide opening located below the fluid dispensing orifice; and a pusher that overlies the dish.

14. The dispenser head according to claim 13, in which the dish defines a bottom, and a side that is substantially steep under normal conditions of use of the head, the dispenser orifice formed in the steep side, such that the fluid can flow by gravity into the bottom of the dish.

15. The dispenser head according to claim 14, in which the dish defines an access rim that is substantially horizontal, and that is situated opposite the steep side.

16. The dispenser head according to claim 15, in which the bottom of the dish is deeper in the proximity of the steep side and slopes gently up to the access rim.

17. The dispenser head according to claim 15, in which the access rim extends over a portion of the outer periphery of the head.

* * * * *